US010328999B2

(12) United States Patent
Trail

(10) Patent No.: US 10,328,999 B2
(45) Date of Patent: Jun. 25, 2019

(54) SYSTEM FOR LAUNCH AND RECOVERY OF REMOTELY OPERATED VEHICLES

(71) Applicant: WT INDUSTRIES, LLC, Houston, TX (US)

(72) Inventor: Douglas Patrick Trail, Houston, TX (US)

(73) Assignee: WT INDUSTRIES, LLC, Houston, TX (US)

( * ) Notice: Subject to any disclaimer, the term of this patent is extended or adjusted under 35 U.S.C. 154(b) by 0 days.

(21) Appl. No.: 15/859,741

(22) Filed: Jan. 2, 2018

(65) Prior Publication Data

US 2019/0112011 A1 Apr. 18, 2019

Related U.S. Application Data

(63) Continuation-in-part of application No. 15/402,157, filed on Jan. 9, 2017, now Pat. No. 10,104,226, which
(Continued)

(51) Int. Cl.
*B63B 27/10* (2006.01)
*B63G 8/00* (2006.01)
(Continued)

(52) U.S. Cl.
CPC ..... *B63B 27/10* (2013.01); *B63B 27/08* (2013.01); *B63G 8/001* (2013.01); *B66C 13/02* (2013.01); *B66C 13/18* (2013.01); *B66C 23/53* (2013.01); *B63B 35/40* (2013.01); *B63B 2035/405* (2013.01); *B63B 2203/00* (2013.01);
(Continued)

(58) Field of Classification Search
CPC ..... B63B 27/00; B63B 27/08; B63B 27/10
USPC .... 60/495; 114/244, 258, 312, 322, 44, 321, 114/326, 328, 331, 337; 166/341, 345; 340/850; 379/418; 405/158, 166, 170, 405/173, 190, 191, 195.1, 210, 157, 161, 405/197; 212/270; 242/557; 250/253;
(Continued)

(56) References Cited

U.S. PATENT DOCUMENTS 4,686,927 A * 8/1987 Hawkes ..... B63C 11/52 104/173.1
5,140,927 A * 8/1992 Tolefson ..... B63B 39/02 114/244
(Continued)

*Primary Examiner* — Gerald Gauthier
(74) *Attorney, Agent, or Firm* — Rao DeBoer Osterrieder, PLLC; Dileep P. Rao

(57) ABSTRACT

The present embodiments relate to launch and recovery systems for a remotely operated vehicle. The embodiments eliminate or minimize the need for load lines, and provide virtually unlimited excursion distances for remotely operated vehicles, limited only by the amount of tether available at the launch point. Further, the embodiments allow for extended deployments of ROVs by allowing recharging of a tether climbing component while submerged. The system can include a launch and recovery assembly, a tether climbing component, and a remotely operated vehicle attached to a remotely operated vehicle tether. The launch and recovery assembly deploys the remotely operated vehicle and the tether climbing component overboard, and the remotely operated vehicle is configured for tethered operation while maintaining the tether climbing component at a desired depth.

14 Claims, 4 Drawing Sheets

Related U.S. Application Data is a continuation-in-part of application No. 14/593,045, filed on Jan. 9, 2015, now Pat. No. 9,540,076.

(60) Provisional application No. 61/926,173, filed on Jan. 10, 2014.

(51) Int. Cl.

| | |
|---|---|
| ***B63B 27/08*** | (2006.01) |
| ***B66C 23/53*** | (2006.01) |
| ***B66C 13/02*** | (2006.01) |
| ***B66C 13/18*** | (2006.01) |
| *B63B 35/40* | (2006.01) |

(52) U.S. Cl.
CPC ..... *B63B 2205/04* (2013.01); *B63B 2209/00* (2013.01); *B63G 2008/005* (2013.01)

(58) Field of Classification Search
USPC ..... 254/333; 367/15; 414/141.6; 701/1, 2, 701/21, 23, 116
See application file for complete search history.

(56) References Cited

U.S. PATENT DOCUMENTS 5,921,713 A * 7/1999 Gjessing ..... F16L 1/26 405/158
6,113,312 A * 9/2000 Nørholmen ..... G02B 6/504 114/312
6,223,675 B1 * 5/2001 Watt ..... B63G 8/001 114/312
6,390,012 B1 5/2002 Watt
6,588,985 B1 * 7/2003 Bernard ..... B63B 21/22 166/338
6,935,262 B2 8/2005 Roodenburg
7,814,856 B1 * 10/2010 Smith ..... B63G 8/41 114/313
9,855,999 B1 * 1/2018 Trail ..... B63B 27/08
2002/0166998 A1 * 11/2002 Selcer ..... B63B 21/66 254/333
2002/0172562 A1 * 11/2002 Worman ..... B65H 75/146 405/161
2004/0059476 A1 * 3/2004 Nichols ..... B63B 22/06 701/21
2005/0160959 A1 * 7/2005 Roodenburg ..... B63B 27/36 114/258
2008/0110389 A1 * 5/2008 Smith ..... B63B 21/66 114/312
2008/0243365 A1 * 10/2008 Altman ..... B63B 21/22 701/116
2008/0247827 A1 * 10/2008 Altman ..... B63B 9/065 405/197
2008/0300742 A1 * 12/2008 Weaver ..... B63C 11/40 701/21
2009/0052992 A1 * 2/2009 Thompson ..... B63C 11/40 405/158
2009/0114140 A1 * 5/2009 Guerrero ..... B63C 11/52 114/321
2009/0252559 A1 * 10/2009 Masters ..... B63C 11/52 405/195.1
2009/0261052 A1 * 10/2009 Vasstrand ..... B63B 27/10 212/270
2010/0157727 A1 * 6/2010 Woodard, Jr. ..... B63C 11/52 367/15
2010/0171637 A1 7/2010 Jaffrey
2011/0061583 A1 * 3/2011 MacKinnon ..... B63G 8/08 114/331
2012/0118217 A1 * 5/2012 Bertelsen ..... B63B 27/36 114/326
2012/0145407 A1 * 6/2012 Varley ..... E21B 17/085 166/345
2012/0204781 A1 * 8/2012 Chun ..... B63G 8/001 114/312
2012/0210926 A1 * 8/2012 Storm, Jr. ..... B63C 11/26 114/337
2012/0263540 A1 * 10/2012 Berg ..... G02B 6/506 405/166
2012/0266803 A1 * 10/2012 Zediker ..... B63G 8/001 114/337
2013/0048294 A1 * 2/2013 Hailey, Jr. ..... E21B 33/035 166/341
2013/0193256 A1 * 8/2013 Hawkes ..... B65H 75/4484 242/557
2013/0333371 A1 * 12/2013 Vigars ..... F03B 13/264 60/495
2014/0107862 A1 * 4/2014 Jung ..... B63G 7/00 701/1
2014/0116312 A1 * 5/2014 Kalwa ..... B63B 35/40 114/44
2014/0116318 A1 * 5/2014 Brandt ..... B63B 35/32 114/321
2014/0165898 A1 * 6/2014 Cierpka ..... G01S 15/89 114/312
2014/0301790 A1 * 10/2014 Chitwood ..... B63B 25/12 405/210
2015/0046014 A1 * 2/2015 Hesse ..... B63G 8/001 701/23
2015/0110582 A1 * 4/2015 Jacobsen ..... B66C 13/02 414/141.6
2015/0112513 A1 * 4/2015 Kerins ..... B63G 8/001 701/2
2015/0268178 A1 * 9/2015 Smith ..... G01N 23/222 250/253

* cited by examiner

SYSTEM FOR LAUNCH AND RECOVERY OF REMOTELY OPERATED VEHICLES

CROSS REFERENCE TO RELATED APPLICATION

The current application claims priority to and the benefit of U.S. patent application Ser. No. 15/402,152, filed Jan. 9, 2017 and issued as U.S. Pat. No. 9,855,999, entitled "SYSTEM FOR LAUNCH AND RECOVERY OF REMOTELY OPERATED VEHICLES", which in turn claims priority to U.S. patent application Ser. No. 14/593,045, filed Jan. 9, 2015 and issued as U.S. Pat. No. 9,540,076, entitled "SYSTEM FOR LAUNCH AND RECOVERY OF REMOTE OPERATED VEHICLES", which in turn claims priority to U.S. Provisional Patent Application Ser. No. 61/926,173 filed Jan. 10, 2014, entitled "SYSTEM FOR REMOTE OPERATED VEHICLE". These references are hereby incorporated in their entirety.

FIELD

The present embodiments relate to a launch and recovery system for a Remotely Operated Vehicle (ROV) with a pass-through tether management system that does not require a load line to support a tether climbing component.

BACKGROUND

Many underwater operations, such as drilling for and production of oil and gas, installation and maintenance of offshore structures, or laying and maintaining underwater pipelines require the use of a remotely operated vehicle (ROV).

An (ROV) is a tethered underwater mobile device. ROVs are typically unoccupied, highly maneuverable, and operated by a dedicated crew aboard a vessel. The deployment of an ROV is typically achieved by launching the unit from either a bottom founded host platform, a floating host platform, or from a dynamically positioned marine vessel dedicated specifically for the purpose of supporting an ROV and/or other installation and subsea intervention equipment, e.g. a multi service vessel (MSV).

Often when working in rough seas or in deeper water, prior art devices utilize a load-carrying umbilical cable along with a tether management system (TMS). The TMS can be a large garage-like housing which contains the ROV during lowering. The TMS can also be a separate system which sits atop the ROV.

The purpose of the TMS is to house the tether and ROV during lowering, and lengthen and shorten the tether during operation. The TMS effectively allows power to be supplied to the ROV, as well as minimizes the effect of cable drag where there are strong underwater currents.

The umbilical cable is an armored cable that contains a group of electrical conductors and fiber optics that carry electric power, video, and data signals between the operator and the TMS. Where used, the TMS then relays the signals and power for the ROV down the tether cable.

Both bottom founded and floating host platforms can be fixed in position at the site and are normally engaged in collateral activities such as drilling and offshore production or construction. Thus, the operations of the ROV can be limited according to the distance that the ROV can travel from the host platform as well as by restrictions in operating periods due to the collateral activities of the host platform.

In the case of dedicated vessel deployment such as an MSV, significant costs can be associated with operation of a fully founded marine vessel and its mobilization to and from the ROV work site. Typically, a dedicated MSV may have a crew of twenty, large cranes with Active Heave Compensation (AHC), and other considerable costs not directly related to the operation of the ROV.

ROV operation and monitoring can be controlled from the host platform or MSV by means of an umbilical line between the host platform or MSV and the Tether Management System (TMS) which stores a limited amount of tether to connect to the ROV. It can be seen from this that the operational distance of the ROV can be directly related to the length of the tether capacity on the TMS unit.

A need exists for an improved launch and recovery system that utilizes pass-through tether management system concepts and advantages while addressing most prominent drawbacks of current systems.

A further need exists for an improved launch and recovery system that can be containerization for standard shipping that can include simple accurate active heave compensation and that has passive guidance for heavy weather deployments.

A further need exists for an improved launch and recovery system that include redundant passive overload protection that eliminates the need for hydraulic power units and can have easy dead ROV recovery capability.

A further need exists for a pass-through tether management system with a tether climbing component connected to the launch and recovery system enabling a remotely operated vehicle (ROV) to be lifted and deployed in water without the need for an armored umbilical or a load line to support the tether management system.

The present disclosure addresses the above needs.

BRIEF DESCRIPTION OF THE DRAWINGS

The detailed description will be better understood in conjunction with the accompanying drawings as follows.

Figure 1:
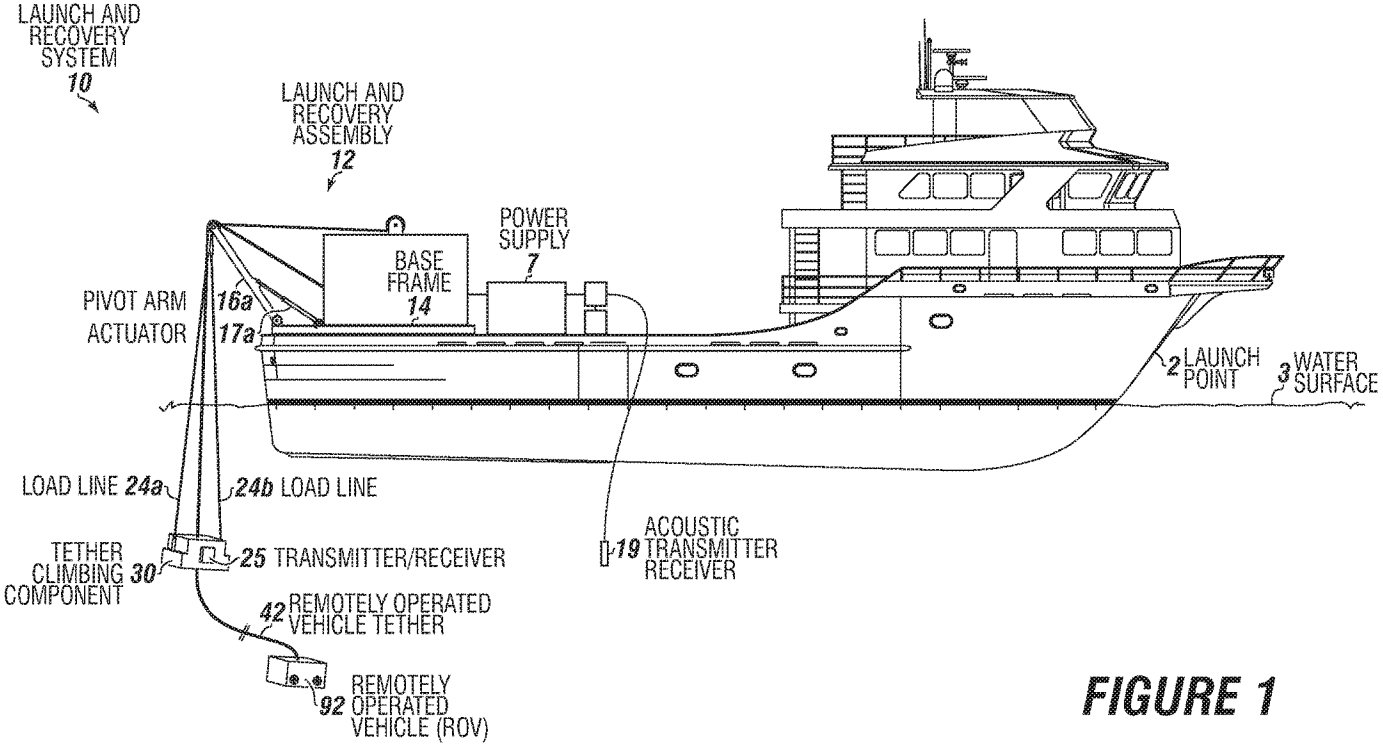
FIG. 1 depicts a side view of an embodiment of the launch and recovery system.

The present disclosure is detailed below with reference to the listed Figures.

DETAILED DESCRIPTION OF THE EMBODIMENTS

Before explaining the present disclosure in detail, it is to be understood that the disclosure is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting.

Specific structural and functional details disclosed herein are not to be interpreted as limiting, but merely as a basis of the claims and as a representative basis for teaching persons having ordinary skill in the art to variously employ the present embodiments. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description herein, but is only limited by the claims which follow, encompassing all equivalents of the subject matter of the claims. Each and every claim is incorporated into the specification as an embodiment of the present disclosure. Thus, the claims are a further description and are an addition to the preferred embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The present embodiments relate to a launch and recovery system for a Remotely Operated Vehicle (ROV) with a pass-through tether climbing component that does not require a load line to support a tether climbing component.

The present disclosure provides a system with a remotely operated vehicle tether or umbilical passing through a tether climbing component and going direct to the ROV. The novelty of the present disclosure is that the ROV can have virtually unlimited excursion distances at a working depth, limited only by the amount of tether able to be stored at the launching point. Further, the ROV can have virtually unlimited deployment time lengths by making use of embodiments wherein the ROV can recharge the tether climbing component while at a desired depth.

In industry, often the terms "tether" and "umbilical" are used to describe equipment which perform similar functions. Typically, "umbilical" is used for an armored communication, power, and control line. Similarly, tether is used for an unarmored communication, power, and control line. For the purposes of this disclosure, the terms tether, remotely operated vehicle tether, and umbilical shall be used interchangeably to mean any communication and/or power and/or control line.

The tether or umbilical acts as the load line. In such an embodiment, a traction system can move the tether climbing component along the length of the tether, with a separate mechanism for attachment of the ROV and, optionally, a separate mechanism to lower/remove the system from the water.

A tether climbing component can maintain the tether or umbilical directly below the launch point at the desired working depth, thereby avoiding any slack or impacts of current forces on the ROV. Extra equipment, such as load lines or additional winches for deploying a load line, can be eliminated, as the tether serves as the load line.

The tether climbing component can be controlled optionally by direct cable, a communication line with a motor and a power source, or with wireless communications such as an acoustic, radio, microwave, laser, and the like.

The embodiments eliminate the need for armored umbilicals to support a TMS. The embodiments significantly reduce the winch size, power requirements, and deck space requirements for launch and recovery of remotely operated vehicles. The embodiments, therefore, provide an alternative that can reduce the current total ROV systems deck weight by more than 40 percent.

The embodied system allows for the use of a smaller transport vessel and requires a smaller deck space which allows for a safer and less crowded work environment.

The present embodiments also eliminate the need for pre-tensioning and need for lebus grooved drum liners as with current armored umbilical winches. With the present embodiments, no bird caging or subsequent umbilical replacements are required.

The embodiments can provide a continuous umbilical or tether direct to the ROV, thereby eliminating the need to terminate an armored umbilical and separate delivered power to a TMS and the ROV. The continuous umbilical increases reliability and eliminates the need for an electrical and fiber optic rotary slip ring at the TMS. The present embodiments have significantly fewer connections and fewer parts and systems than current systems. Fewer connections and parts means that troubleshooting is simplified and downtime and repair costs are drastically reduced.

The continuous umbilical in the present embodiments allows for unlimited excursion distance from the launch point, as the distance is limited only by total tether length less the working depth. The present embodiments also allow for ROV touchdown monitoring from a lay vessel.

The embodiments provide simpler re-terms for the tether or umbilical. The user only needs to cut back and re-connect at the ROV or connect a whole spare umbilical or tether. Traditional tether replacements are typically a full day job; that replacement time is significantly reduced with the present embodiments.

In embodiments, a capstan or traction winch can be coupled to a low-tension storage reel, thereby reducing the horsepower required since the load on the traction winch is applied at constant diameter. No additional power is required regardless of the depth capacity of system. Further, the speed can be constant throughout deployments at any depth.

Various embodiments can eliminate hydraulic power units (HPU) completely, therefore removing costly HPU issues, such as leaks and maintenance. All-electric embodiments reduce the possibility of environmental disasters by eliminating the need for hydraulics entirely from the system.

The present embodiments disclose a launch and recovery system for a remotely operated vehicle comprising a launch and recovery assembly, tether climbing component, and a remotely operated vehicle.

The launch and recovery assembly can comprise a crane and a winch and a remotely operated vehicle tether. "Crane and winch" refers to any known mechanism for lowering and raising equipment as known to persons having ordinary skill in the art. "Remotely operated vehicle tether" refers to any connecting member or structure in communication with the crane and winch and the ROV, allowing the ROV to be raised and lowered by the crane and winch.

The tether can serve as the load line to lower the ROV and the tether climbing component into water (or any other operational area). In embodiments, the ROV tether can be spooled on the winch, or spooled separately and passed through the winch (such as with a capstan winch type arrangement). The length of the tether is the limiting factor as to how far the ROV can be deployed. In embodiments, the tether can be spooled on the winch for storage and operation.

In instances where an extremely heavy ROV and tether climbing component are to be deployed, a separate deployment frame can be employed and attached the tether climbing component to minimize load on the tether. Such a deployment frame can utilize a second winch to traverse the air/water interface prior to releasing the tether climbing component. Otherwise, a single winch can be utilized to lower the tether climbing component and the ROV, as well as pay in and pay out tether.

In embodiments, an active and/or passive heave compensation system can be utilized in conjunction with the presently disclosed system to minimize the effect of waves and/or vessel heave on the tether climbing component and the ROV.

In embodiments, the ROV can be detachably secured to the tether climbing component to allow for minimized load on the tether while traversing the air water interface.

The tether climbing component can comprise a frame, a tether climbing device secured to the frame, a motor connected to the tether climbing device to pay in and out the remotely operated vehicle tether, and a power source.

The frame can be any housing or structure that holds and positions the components of the tether climbing device as needed. A tether climbing device can be secured to the frame and be in communication with the ROV tether. In embodiments, the frame can also have a connector or latch to detachably be secured to the ROV. In embodiments, the frame can have a connector or latch to detachably be secured to the deployment frame.

The tether climbing device can have a traction mechanism to grip the ROV tether and climb up and down the tether. Such a mechanism can be a mechanical traction device utilizing friction and a motor. Other embodiments are contemplated utilizing magnetic or electromagnetic means to position the tether climbing device on the ROV tether.

Upon reaching a desired depth, the tether climbing device can maintain a desired depth by climbing up or down the tether. In embodiments, the desired depth can be a range of depths, to eliminate constant corrections of depth by the tether climbing component.

A remotely operated vehicle can be attached to the remotely operated vehicle tether opposite the tether climbing component from the crane and winch. Upon reaching a desired depth, the tether climbing component can remain substantially stationary relative to the launch point while the ROV is given an excursion length of tether to perform its duties.

For example, a tether climbing device and ROV can be lowered to a desired working vertical depth of 100 meters. The tether climbing component can be controlled to maintain its depth between 98 meters and 102 meters, thus accounting for up to a two-meter heave of the body of water. If the tether climbing component leaves this desired depth range, the component will climb up or down the tether to reach 100 meters. The ROV may need to travel 50 meters horizontally to accomplish its tasks. The winch can continue to pay out tether to give the ROV the necessary excursion distance. The tether climbing component would continue to climb the tether as this tether is payed out in order to maintain its desired depth. When the ROV has completed its tasks, and the tether is payed back in by the winch, the tether climbing component can climb down the tether until it reaches the ROV.

As will be readily apparent to persons having ordinary skill in the art, coupling the presently disclosed system with an active and/or passive heave compensation system, either with or without a deployment frame, can aid the tether climbing component in maintaining a desired depth with fewer corrective climbs up or down the tether.

In embodiments, the tether climbing device can allow the remotely operated vehicle tether to bend only in one direction, and/or align the remotely operated vehicle tether to exit the tether climbing device in a substantially vertical orientation. In embodiments in which the tether climbing component is towed with a traveling launch point, the tether climbing device can align the remotely operated vehicle tether to exit the tether climbing device in a substantially horizontal orientation, or any angle desired by persons having ordinary skill in the art.

In embodiments, the tether climbing component comprises a power source, such as a battery. In situations, wherein it is desirable for the ROV to be deployed for extended time periods without recovery, the power source may be rechargeable by the ROV, which in turn may have a larger battery, or receive power directly from the tether. For example, the tether climbing component can have a connector for attaching to and receiving power from the ROV. In other embodiments, the power source can be capable of electrically or magnetically induction charging from the ROV when the ROV is positioned proximate the tether climbing component.

In embodiments, the tether climbing component can further comprise a motor or a jet configured to move and/or adjust the attitude and/or inclination of the tether climbing component under water.

In embodiments, the tether climbing component can further comprise a fin to stabilize or align the tether climbing component in fluids. This may be especially useful when the tether climbing component is being towed, and it is desirable to make the tether climbing component more hydrodynamic and/or aerodynamic.

In embodiments, the tether climbing component can further comprise a ballast weight. In instances, wherein it is desirable to deploy the ROV at great depths, a ballast weight may be necessary to allow the tether climbing component to reach the desired depth which it must then maintain. Persons having ordinary skill in the art can determine if a ballast is necessary based upon the desired working depth.

In embodiments, the tether climbing component can further comprise a transmitter and receiver for communications. Such equipment can be wired directly, or wireless communication. Any known wireless communication means known to persons having ordinary skill in the art can be utilized, such as acoustic, radio, microwave, laser, and the like.

The present disclosure also includes a method of deploying a remotely operated vehicle.

The method can include: providing the launch and recovery system as described and claimed, deploying the remotely operated vehicle into a liquid, lowering the tether climbing component to a desired depth, and maintaining the tether climbing component at the desired depth by using a motor to pay in or out the remotely operated vehicle tether, thereby causing the tether climbing component to climb up or down the tether.

In various embodiments, the method can comprise any single step or combination of: attaching a deployment frame and a second winch to the tether climbing component to allow for lowering of heavy ROVs, recharging a power source in communication with the tether climbing component with the power supplied to the remotely operated vehicle, and wherein recharging the power source occurs through a physical connection, a contact area, or a proximity charging means.

Turning now to the Figures, FIG. 1 depicts a side view of an embodiment of the launch and recovery system 10 as it is used from a launch point 2, which is depicted here as a water vessel.

A tether climbing component 30 can be connected to the launch and recovery assembly 12. While prior art devices required load lines 24*a* and 24*b*, the present embodiments do not require them unless used with a deployment frame. In the event a deployment frame is utilized, it can be detachably secured to the tether climbing component 30, and the load lines 24*a* and 24*b*. Upon traversing the air water interface and entering the water, the deployment frame can be detached from tether climbing component 30.

The tether climbing component 30 can have its own power supply. In embodiments, an acoustic transmitter receiver 19 can be connected to or in communication with the launch point 2 for communicating with the tether climbing component 30 The tether climbing component 30 can have a tether climbing component acoustic transmitter/receiver 25 for communicating with the acoustic transmitter receiver 19 deployed from the launch point 2. Other similar means of communication with the tether climbing component can be utilized as discussed above.

The launch and recovery assembly 12 can have a base frame 14 for mounting removably to the launch point 2. In embodiments, one or more pivot arms 16*a* can secure to the base frame 14.

Power supply 7 can power the launch and recovery assembly 12, which can raise the tether climbing component from the deck of the launch point 2, and then pivot the pivot arms until the tether climbing component is positioned overboard of the hull of the offshore object. The tether climbing component can then be lowered below the water surface 3.

The tether climbing component can latch to a remotely operated vehicle 92 (ROV) prior to being raised, or alternatively rest on the ROV 92. The ROV 92 and tether climbing component can then be deployed together into the body of water. Once in the water, the ROV 92 can de-latch from the tether climbing component (if latched) and the ROV tether 42 can pay out through the tether climbing component for operation of the ROV.

In embodiments in which the weight of the ROV 92 and tether climbing component 30 in air is too great to be supported by the remotely operated vehicle tether 42, a separate deployment frame and winch can be latched to the tether climbing component 30 for traversing the air/water interface and entering the water. The deployment frame can then be detached from the tether climbing component 30. In embodiments, the deployment frame can be similar or identical in structure to the tether climbing component 30. Using a second winch and a load line in conjunction with the deployment frame can still minimize necessary equipment as compared to prior art, as the deployment frame only needs to enter the water prior to detaching from the tether climbing component 30, and need not be lowered fully to working depth.

Figure 2:
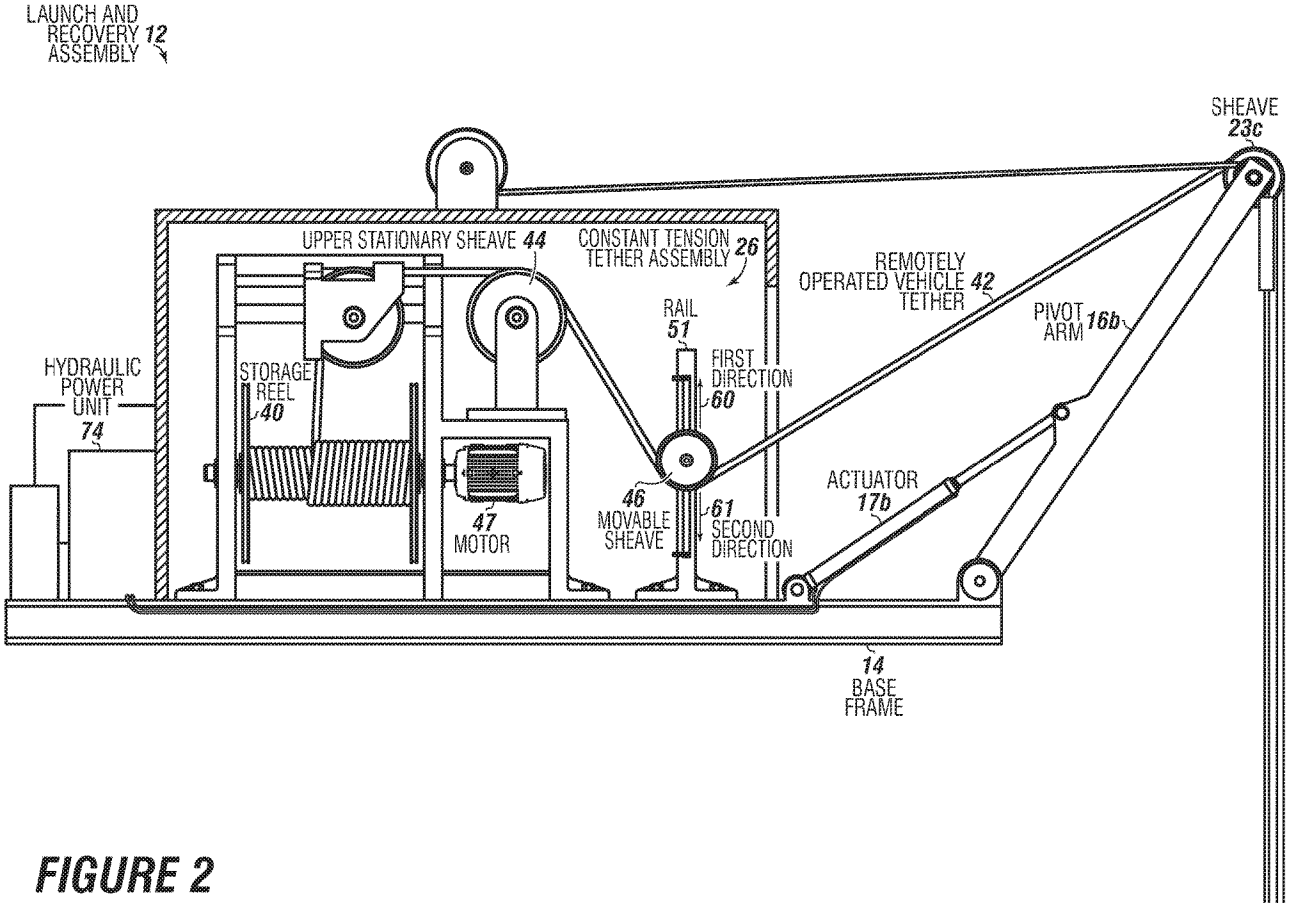
FIG. 2 depicts a side view of an embodiment of the launch and recovery assembly.

FIG. 2 depicts a side view of an embodiment of the launch and recovery assembly. A base frame 14 can be used in embodiments to house the components of the system.

The remotely operated vehicle (ROV) tether 42 for paying out over a sheave can be attached to the cross member.

A constant tension tether assembly 26 can be utilized in embodiments for paying in and out of an ROV tether 42. The constant tension tether assembly can have a movable sheave 46 for receiving the ROV tether from a sheave 23*c* on the cross member. The constant tension tether assembly can have an upper stationary sheave 44 for receiving the ROV tether 42 from the movable sheave 46. The constant tension tether assembly can have a storage reel 40 with a motor 47. The storage reel 40 with a motor 47 can be the winch used to lower a tether climbing component and ROV, as well as pay in and out tether after reaching a desired depth.

In embodiments, a launch and recovery assembly 12 can have a hydraulic power unit 74 connected to actuator 17*b* for positioning pivot arms 16.

The movable sheave 46 can roll up and down on a rail 51 and can be mounted at a 90-degree angle to the base frame 14. The movable sheave can slide in a first direction 60 along the rail 51 during deployment of the ROV tether causing payout of ROV tether from the storage reel and can slide in a second direction 61 on the rail 51 during recovery of ROV tether to ensure proper spooling on storage reel 40.

Figure 3:
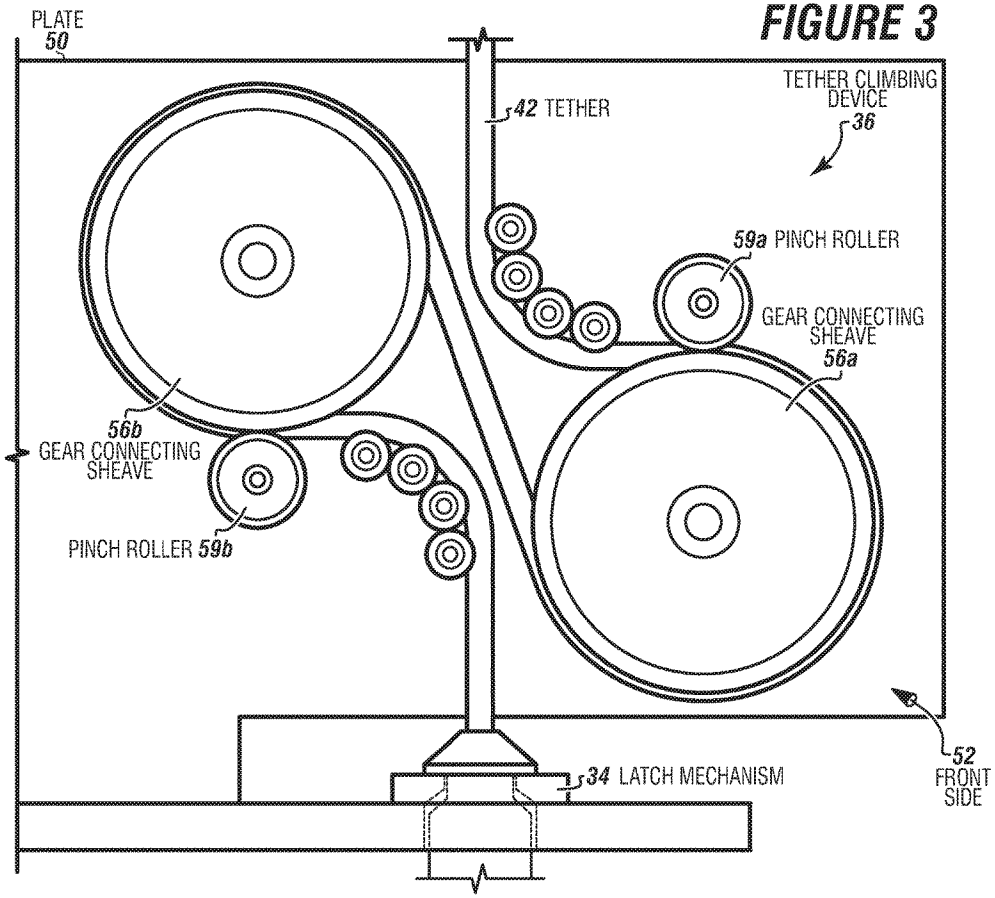
FIG. 3 depicts a detailed view of one embodiment of the tether climbing component.

FIG. 3 depicts a detailed view of one embodiment of the tether climbing component. The tether climbing component can have a tether climbing device 36 mounted on a plate 50 (which can act as the frame of the tether climbing component) showing the front side 52. The plurality of gear connecting sheaves 56*a* and 56*b* can be mounted in a spaced apart relationship on the front side. One or more pinch rollers 59*a*, 59*b* can be mounted to the plate. Each pinch roller can be mounted opposing a respective traction sheave.

The ROV tether 42 from the launch and recovery assembly can be received between a first pinch roller 59*a* and first gear connecting sheave 56*a*. The ROV tether rolls around the first gear connecting sheave 56*a* to a second gear connecting sheave 56*b*, then rolls around the second gear connecting sheave to a second pinch roller 59*b* opposite the second gear connecting sheave through the optional latch mechanism 34 for connecting to an ROV. The gear connecting sheaves 56*a* and 56*b* can be motorized to allow for the tether climbing component to climb up and down tether 42 as necessary.

Figure 4:
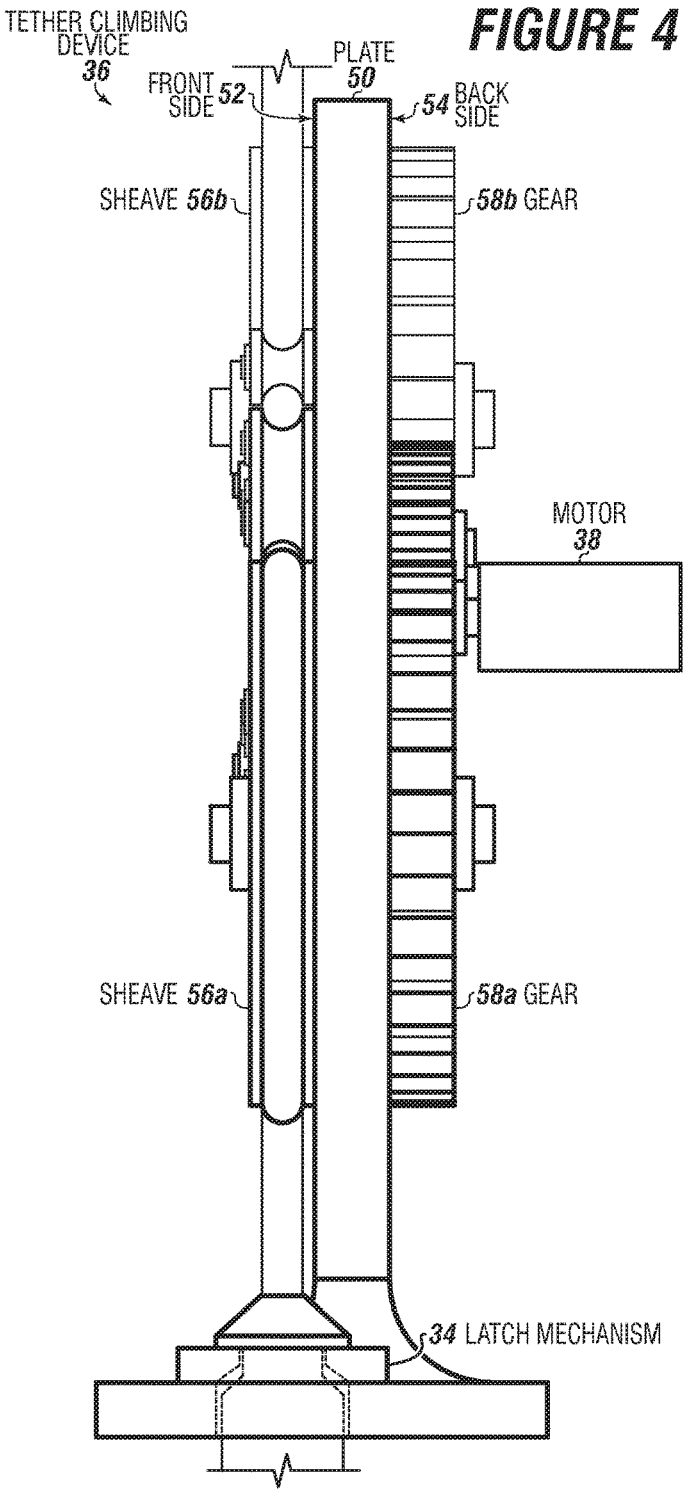
FIG. 4 depicts an end view of one embodiment of the tether climbing device

FIG. 4 depicts an end view of one embodiment of the tether climbing device 36 shown in FIG. 3 used in the tether climbing component with gears and sheaves mounted thereto. One or more gears 58*a*, 58*b* can be mounted on a back side 54 of the plate 50 in a spaced apart relationship. A motor 38 for climbing tether 42, latch mechanism 34, one or more gear connecting sheaves 56*a*, 56*b*, and front side are also shown. In embodiments, the plate 50 can also act as a shaftless bearing housing, allowing for inserts to absorb thrust and radial loads. The plate can not only provide structural support to the tether traction device, but can contain sheets or strips of bearing materials in a cavity between components located on either side of the plate. These bearing materials can be made of polymers such as TEFLON®, or any suitable material desired by persons having ordinary skill in the art.

In embodiments, a single gear connecting sheave can be utilized to ensure that the tether bends only in one direction, i.e. there is no reverse bend induced by the tether climbing component.

In claimed embodiments, the launch and recovery assembly deploys the tether climbing component overboard with an ROV and supports the tether climbing component and ROV with the tether, wherein the ROV is disengaged for tethered operation while maintaining the tether climbing component at an operational depth.

While the disclosure emphasizes the presented embodiments and Figures, it should be understood that within the scope of the appended claims, the disclosure may be embodied other than as specifically enabled herein.

What is claimed is:

1. A launch and recovery system for a remotely operated vehicle comprising:

a. a launch and recovery assembly comprising:
(i) a crane and a winch; and
(ii) a remotely operated vehicle tether;

b. a tether climbing component comprising:
(i) a frame;
(ii) a tether climbing device secured to the frame, wherein the tether climbing device positions the tether climbing component at a desired depth and receives the remotely operated vehicle tether;
(iii) a motor connected to the tether climbing device to pay in and out the remotely operated vehicle tether, wherein the motor pays in and out the remotely operated vehicle tether to allow the remotely operated vehicle a desired excursion distance while moving the tether climbing component up and down the tether to maintain a desired depth; and
(iv) a power source in communication with the motor; and c. a remotely operated vehicle attached to the remotely operated vehicle tether; and wherein the launch and recovery assembly deploys the remotely operated vehicle and the tether climbing component overboard, and further wherein the remotely operated vehicle is configured for tethered operation while maintaining the tether climbing component at the desired depth.

2. The system of claim 1, wherein the tether climbing device allows the remotely operated vehicle tether to bend only in one direction.

3. The system of claim 1, wherein the tether climbing device aligns the remotely operated vehicle tether to exit the tether climbing device in a substantially vertical orientation.

4. The system of claim 1, further comprising a deployment frame detachably secured to the tether climbing component.

5. The system of claim 1, wherein the tether climbing component further comprises a power source configured for selective communication with the remotely operated vehicle when the remotely operated vehicle is proximately positioned.

6. The system of claim 1, wherein the tether climbing component further comprises a motor or a jet configured to adjust an attitude and/or inclination of the tether climbing component.

7. The system of claim 1, wherein the tether climbing component further comprises a fin to stabilize or align the tether climbing component in fluids.

8. The system of claim 1, wherein the tether climbing component further comprises a ballast weight.

9. The system of claim 1, wherein the tether climbing component further comprises a transmitter and receiver for communicating.

10. The system of claim 5, wherein the power source receives power from the remotely operated vehicle.

11. A method of deploying a remotely operated vehicle comprising:

a. providing the launch and recovery system comprising:
(i) a launch and recovery assembly comprising:
(a) a crane and a winch;
(b) a remotely operated vehicle tether; and
(ii) a tether climbing component comprising:
(a) a frame;
(b) a tether climbing device secured to the frame, wherein the tether climbing device positions the tether climbing component at a desired depth and receives the remotely operated vehicle tether; and
(c) a motor connected to the tether climbing device to climb up or down the remotely operated vehicle tether, wherein the motor pays in and out the remotely operated vehicle tether to allow the remotely operated vehicle a desired excursion distance while moving the tether climbing component up and down the tether as necessary to maintain the desired depth; and
(iii) a remotely operated vehicle attached to the remotely operated vehicle tether;

b. deploying the remotely operated vehicle into a liquid;

c. lowering the tether climbing component to a desired depth; and d. maintaining the tether climbing component at the desired depth by using the motor to pay in or out the remotely operated vehicle tether, thereby causing the tether climbing component to climb up or down the tether.

12. The method of claim 11, further comprising: detachably securing a deployment frame to the tether climbing component to allow for traversing the air/water interface.

13. The method of claim 11, further comprising: recharging a power source in communication with the tether climbing component with the power supplied to the remotely operated vehicle.

14. The method of claim 13, wherein recharging the power source occurs through a physical connection, a contact area, or a proximity charging means.

* * * * *